US009953483B2

(12) United States Patent
Penacho et al.

(10) Patent No.: US 9,953,483 B2
(45) Date of Patent: Apr. 24, 2018

(54) METHOD OF GAMING, A GAMING SYSTEM AND A GAME CONTROLLER

(71) Applicant: Aristocrat Technologies Australia Pty Limited, North Ryde (AU)

(72) Inventors: Gary Joseph Penacho, Henderson, NV (US); Casey Lyle Condron, Las Vegas, NV (US); Thomas Tuomey, Las Vegas, NV (US); Kurt Larsen, Las Vegas, NV (US); Charles Schotborgh, Las Vegas, NV (US); Adam Pippin, Las Vegas, NV (US); Ryan Shawn Carr, Las Vegas, NV (US)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 172 days.

(21) Appl. No.: 14/864,522

(22) Filed: Sep. 24, 2015

(65) Prior Publication Data

US 2016/0093147 A1 Mar. 31, 2016

(30) Foreign Application Priority Data

Sep. 26, 2014 (AU) ..... 2014903842

(51) Int. Cl.
*G07F 17/32* (2006.01)

(52) U.S. Cl.
CPC ..... *G07F 17/3213* (2013.01); *G07F 17/326* (2013.01)

(58) Field of Classification Search
CPC ..... G07F 17/326; G07F 17/3213
See application file for complete search history.

(56) References Cited

U.S. PATENT DOCUMENTS

2013/0184055 A1* 7/2013 Schultz ..... G07F 17/3244 463/20
2014/0162749 A1* 6/2014 Ryan ..... G07F 17/3244 463/20
2014/0342799 A1* 11/2014 Deitz ..... G07F 17/3213 463/20

* cited by examiner

*Primary Examiner* — Omkar Deodhar
*Assistant Examiner* — Shauna-Kay Hall
(74) *Attorney, Agent, or Firm* — McAndrews, Held & Malloy, Ltd.

(57) ABSTRACT

An electronic method of gaming in a gaming system. The method comprises displaying, on a display, an evaluation area comprising a plurality of columns of symbol display positions divided between first and second gaming instances by a border such that symbol display positions on one side of the border are allocated to the first game instance and symbol display positions on the other side of the border are allocated to the second game instance; upon a border change condition being met, adjusting, using a game controller, the allocation of symbol positions between the first game instance and the second game instance so that the border between the first and second game instances changes; and determining, using the game controller, whether to make an award in respect of at least one of the first and second game instances based on symbols displayed at the symbol positions after the border changes.

26 Claims, 8 Drawing Sheets

METHOD OF GAMING, A GAMING SYSTEM AND A GAME CONTROLLER

RELATED APPLICATIONS

This application claims priority to Australian Provisional Patent Application No. 2014903842 having an International filing date of Sep. 26, 2014, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In electronic gaming systems such as spinning reel or "slot" gaming machines, symbols are selected for display on a display of the machine. The displayed symbols are evaluated to determine whether an award is to be made to a player.

While such gaming systems provide players with enjoyment, a need exists for alternative gaming systems in order to maintain or increase player enjoyment.

BRIEF SUMMARY OF THE INVENTION

In a first aspect, the invention provides an electronic method of gaming in a gaming system comprising a display and a game controller, the method comprising:

displaying, on the display, an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance;

upon a border change condition being met, adjusting, using the game controller, the allocation of symbol positions between the first game instance and the second game instance so that the border between the first and second game instances changes; and determining, using the game controller, whether to make an award in respect of at least one of the first and second game instances based on symbols displayed at the symbol positions after the border changes.

In an embodiment, adjustment in the allocation of symbol display positions results in one of the first and second gaming instances being allocated at least one more symbol display positions previously allocated to the other of the first and second gaming instances.

In an embodiment, adjustment in the allocation of symbol display positions results in one of the first and second gaming instances having more symbol display positions than previously and the other of the first and second gaming instances having fewer symbol display positions than previously.

In an embodiment, the method comprises selecting symbols for the first and second gaming instances independently of one another.

In an embodiment, the method comprises selecting symbols from a first symbol set for the first gaming instance and selecting symbols from a second, different symbol set for the second gaming instance.

In an embodiment, the border divides the columns of symbol display positions between each gaming instance.

In an embodiment, adjusting the allocation of symbol display position comprises adjusting the symbol display positions of one or more columns.

In an embodiment, the adjustment to the allocation of symbol display position in at least one column is randomly determined from a set of possible adjustments.

In an embodiment, the set of possible adjustments is 0, 1 or 2 symbol display positions.

In an embodiment, the adjustment to the allocation of symbol display position in at least one column is defined.

In an embodiment, the method comprises determining after selection but prior to display of symbols of the gaming instances whether the selected symbols for symbol display positions of one of the gaming instances correspond to a losing outcome, and wherein the border change condition includes that one of the gaming instances has a losing game outcome.

In a second aspect, the invention provides an electronic game controller comprising:

a display controller configured to control a display of a gaming system to display an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance, and a symbol display position allocator configured to, upon a border change condition being met, adjusting the allocation of symbol positions between the first game instance and the second game instance so that the border between the first and second game instances changes; and an outcome evaluator configured to determine whether to make an award in respect of at least one of the first and second game instances based on symbols displayed at the symbol positions after the border changes.

In a third aspect, the invention provides a gaming system comprising:

a display;

a game controller configured to:

control the display to displaying an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance;

upon a border change condition being met, adjust the allocation of symbol positions between the first game instance and the second game instance so that the border between the first and second game instances changes; and determine whether to make an award in respect of at least one of the first and second game instances based on symbols displayed at the symbol positions after the border changes.

In a fourth aspect, the invention provides a gaming system comprising:

means for displaying an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance;

means for upon a border change condition being met, adjusting the allocation of symbol positions between the first game instance and the second game instance so that the border between the first and second game instances changes; and means for determining whether to make an award in respect of at least one of the first and second game instances based on symbols displayed at the symbol positions after the border changes.

In a fifth aspect, the invention provides computer program code which when executed implements the above method.

In a sixth aspect, the invention provides a tangible computer readable medium comprising the above program code.

BRIEF DESCRIPTION OF SEVERAL VIEWS OF THE DRAWINGS

Embodiments of the invention will now be described with reference to the accompanying drawings in which.

DETAILED DESCRIPTION OF THE INVENTION

Figure 1:
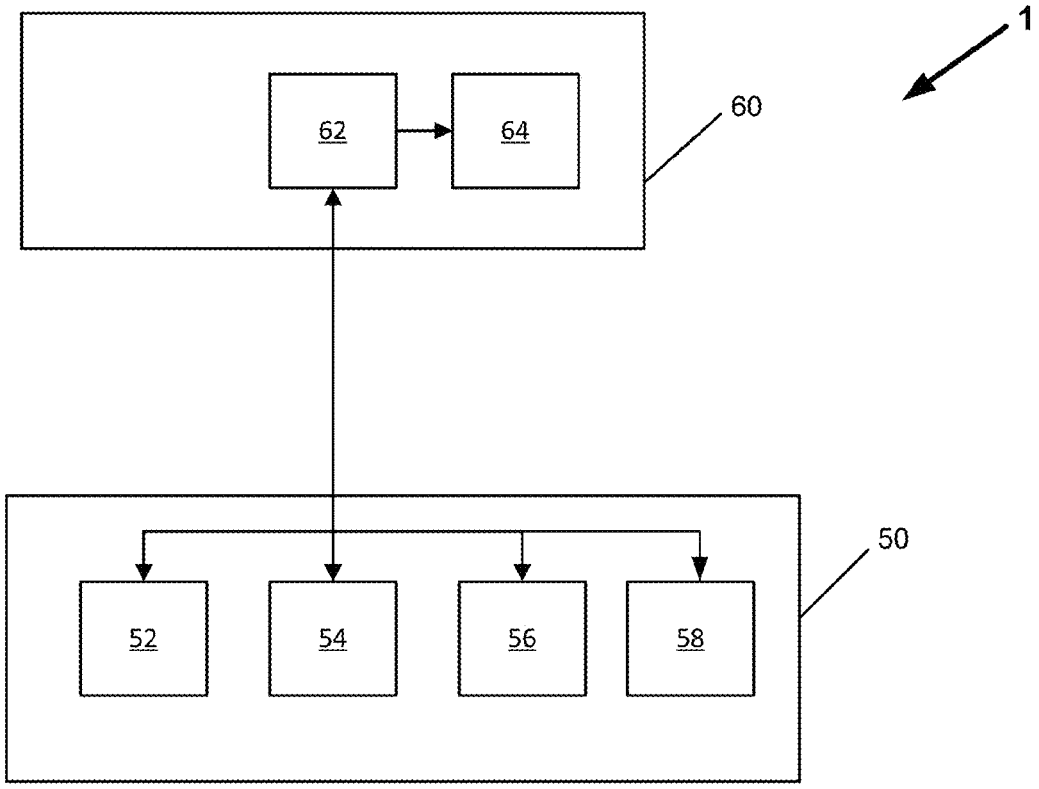
FIG. 1 is a block diagram of the core components of a gaming system.

Referring to the drawings, there is shown an embodiment of an electronic gaming system having an electronic game controller arranged to operate the gaming system to implement a game where first and second separate game instances are conducted concurrently in a symbol evaluation area that is divided between the game instances such that symbol display positions of the evaluation area are allocated to either a first game along a border between the two game instances. In response to a border change condition being met, there is a change of allocation of symbol display positions between the two gaming instances such that the border between the two gaming instances changes. In an embodiment, one of the game instances gains at least one symbol display position while the other of the gaming instances loses an equivalent number of symbol display positions. In an embodiment, part of the border change condition is that it has been determined that symbols selected for the gaming instance which loses symbol display position do not include any winning symbol combinations. The symbol display position or positions added to the other of the gaming instances may result in a winning symbol combination or enhance an existing winning symbol combination.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
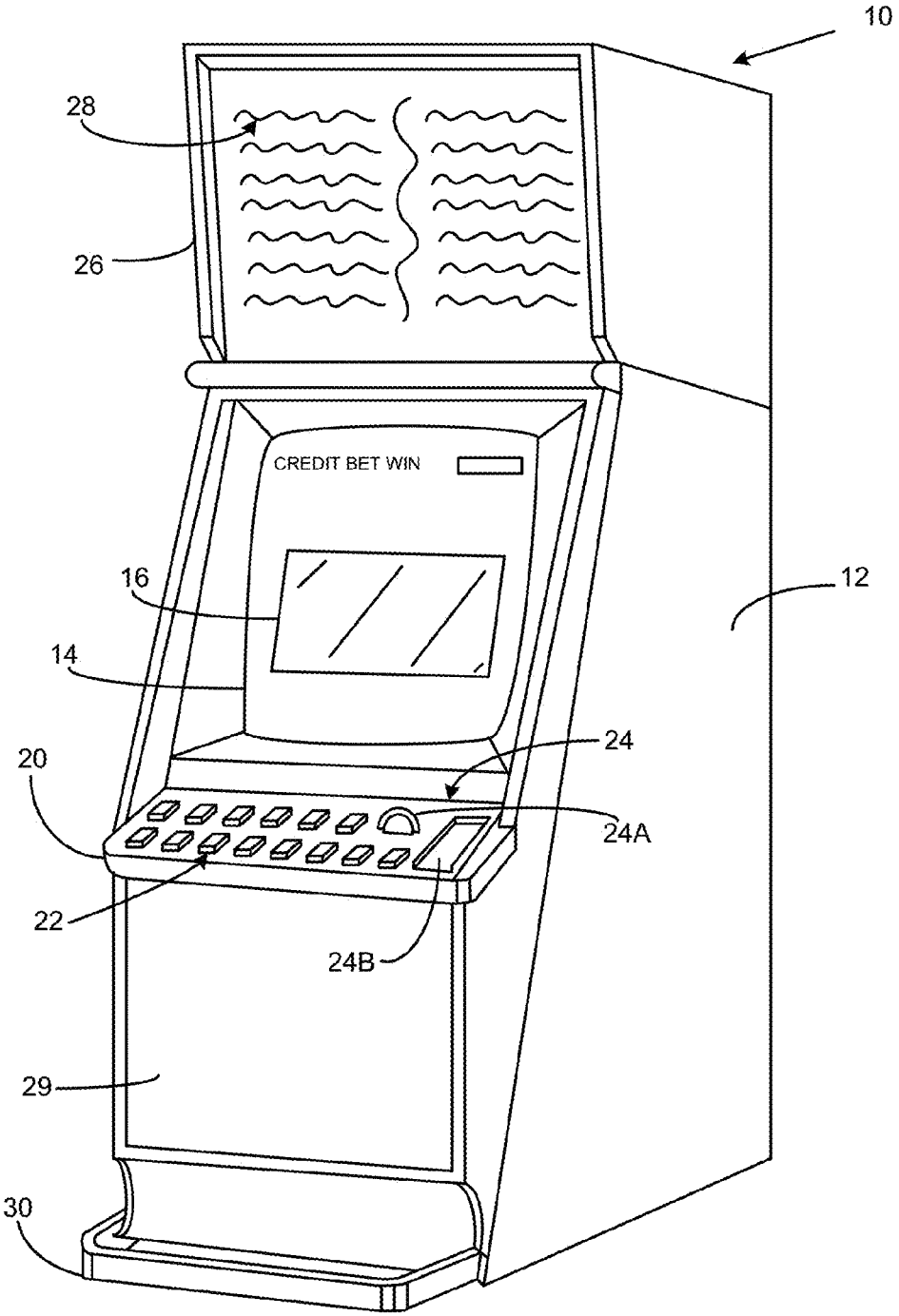
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. Alternatively, the display 14 may be a liquid crystal display, plasma screen, any other suitable video display unit. The top box 26 may also include a display, for example a video display unit, which may be of the same type as the display 14, or of a different type.

Figure 3:
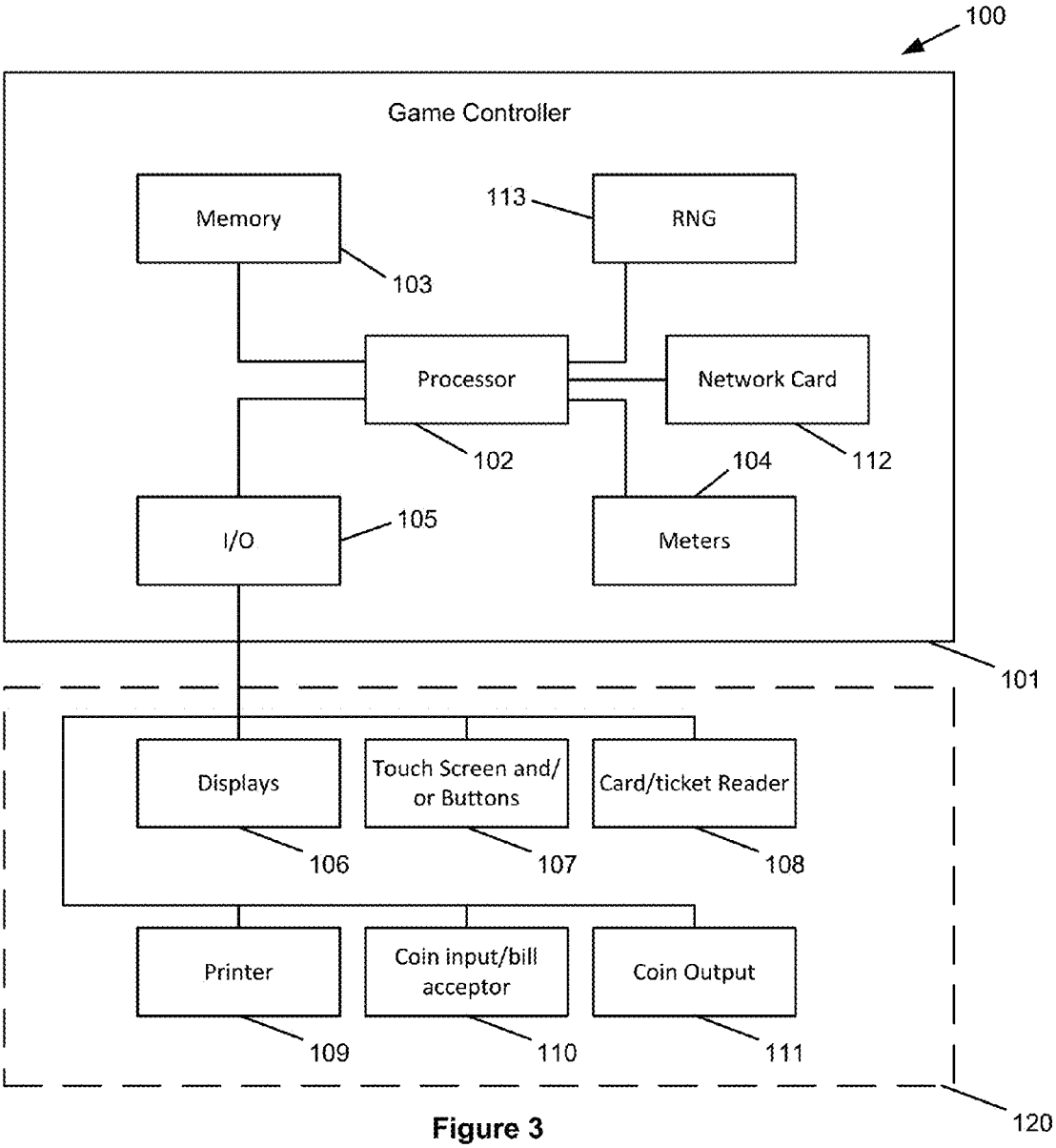
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
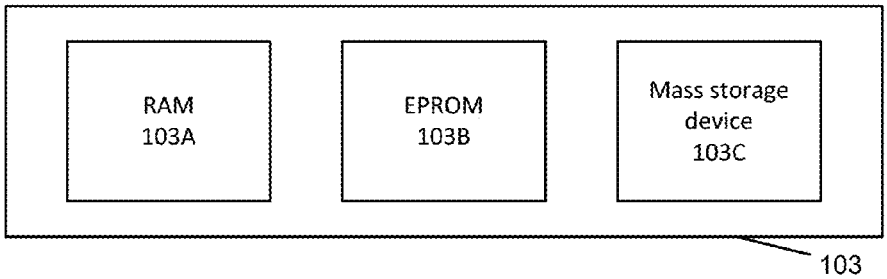
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
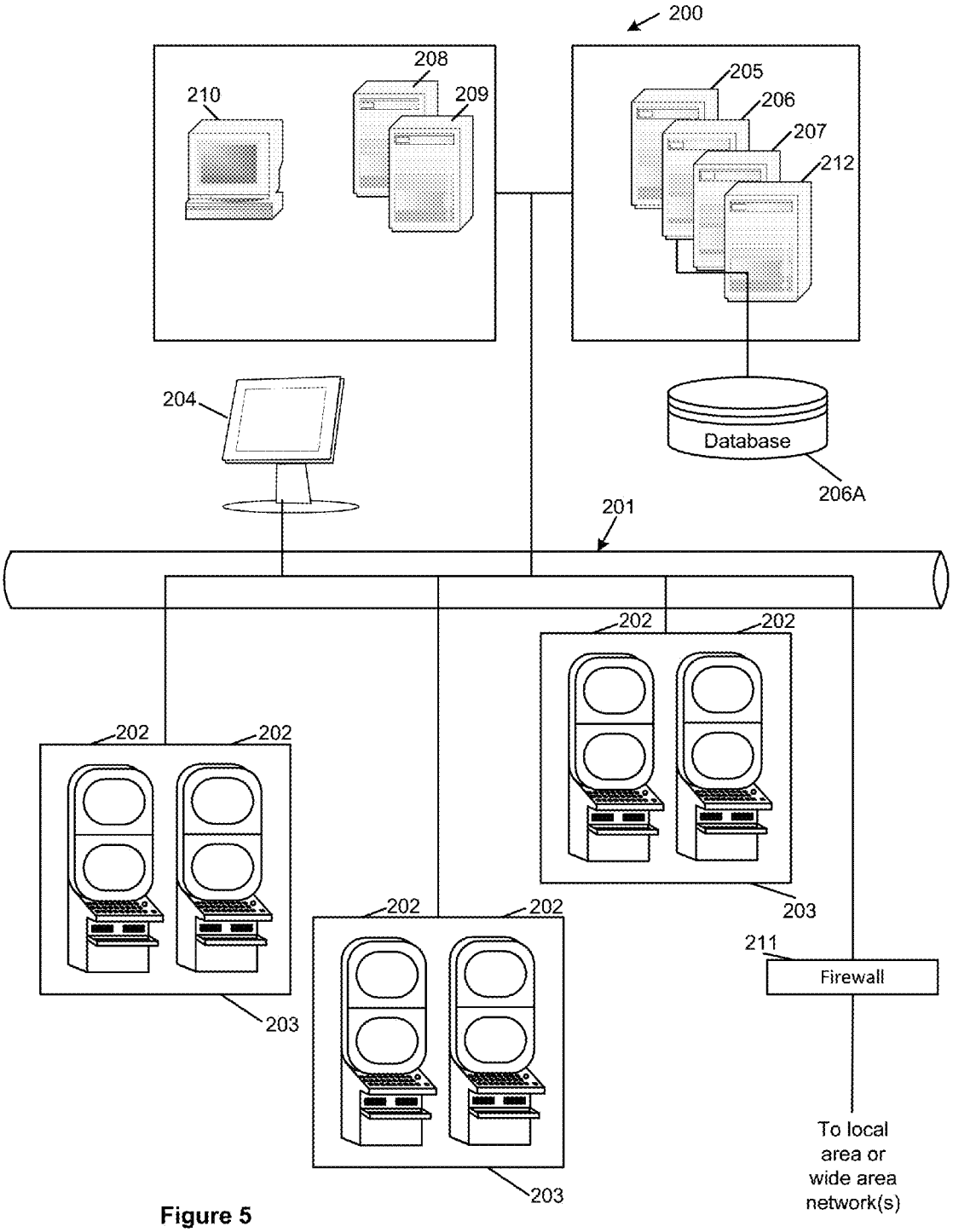
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager for the game and to initiate a play of the game. In the embodiment, at least certain of the wagers that the player can wager entitles the player to two separate gaming instances 820, 830 being carried out in a symbol evaluation area 810 as shown in FIGS. 8A and 8B.

Figure 6:
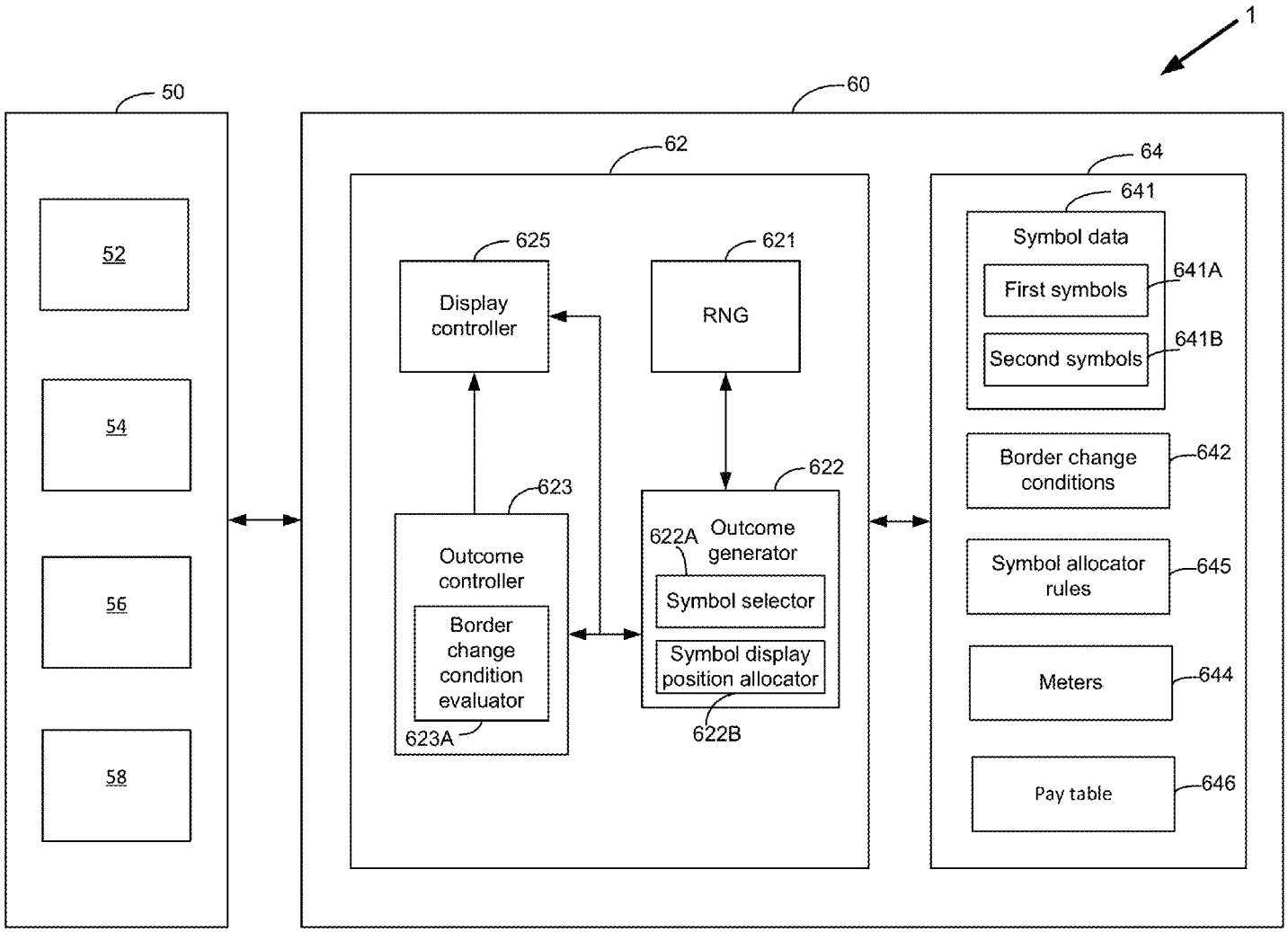
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include display controller 625 which controls the display 54 to display the symbol evaluation area. In an embodiment, the symbol evaluation area 810 is a rectangular array of symbol display positions having a plurality of rows and a plurality of columns. In an embodiment, before the player initiates play of the game, symbols from a previous play of the game are displayed at the display positions.

Figure 8A:
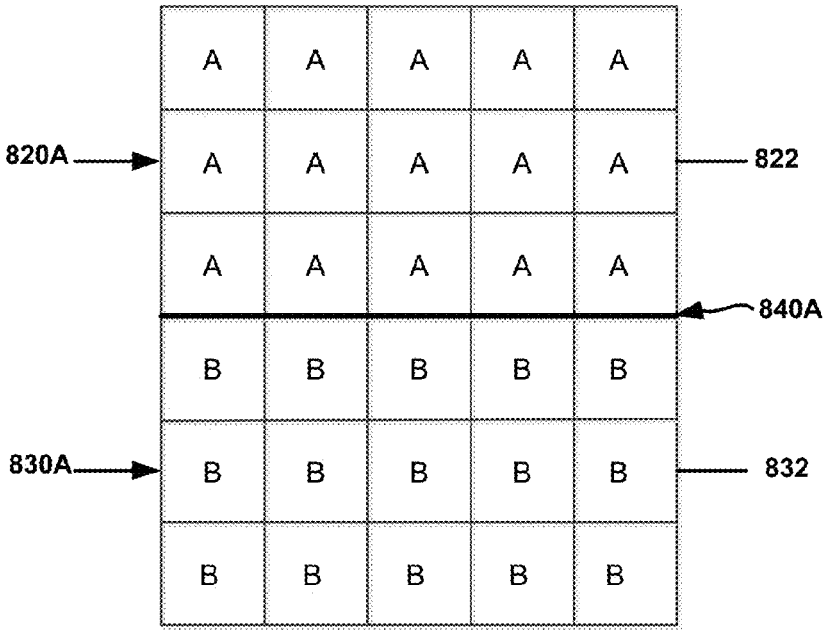
FIGS. 8A and 8B shows an example of changing the allocation of symbol display positions.
Figure 8B:
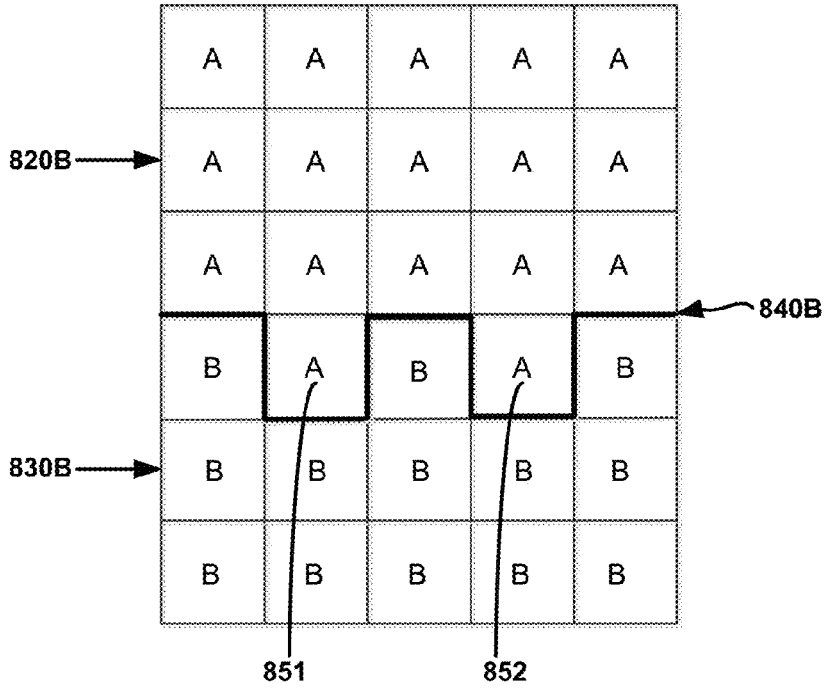

As can be seen from FIG. 8A, initially the two separate game instances are allocated evenly sized parts of the symbol evaluation area 810—i.e. the same number of symbol display positions. In the example of FIG. 8A each game instance is initially allocated fifteen symbol display positions. In FIGS. 8A and 8B, the 'A' symbols at each of the symbol display positions of the first game instance 820 indicate that symbols of the first game instance 820 are selected from a first set of symbols and the 'B' symbols at each of the symbol display positions of the second game instance 830 indicate that symbols of the second game instance 830 are selected from a second set of symbols.

The outcome generator 622 operates in response to the player's operation of game play mechanism 56 to place t wager and initiate a play of the game and generates a game outcome which will then be evaluated by outcome evaluator 623.

In an embodiment, there are a number of stages to forming a game outcome. The first part of forming the game outcome is for a symbol selector 622A to select symbols from the first and second sets of symbols specified by symbol data 641 using random number generator 621 to form an initial game outcome. One example of generating a first game outcome is for the symbol selector 622A to select symbols from symbol data 641 in the form of a plurality of symbol sets corresponding to respective ones of a plurality of reels. The symbol sets specify a sequence of symbols for each reel such that the symbol selector 622A can select all of the symbols to be displayed for each reel by selecting a stopping position in the sequence. In the example shown in FIG. 8, in games where the border is not changed three symbols of each of five reels are displayed for each of gaming instances. For example, by selecting a stopping position for each reel that corresponds to a middle row 822, 832 for each gaming instance 820, 830.

In an embodiment, before the selected symbols are advised to the display controller 625 which will cause them to be displayed on display 54 at the symbol display positions, a determination is made as to whether a border change condition is met 642. In an embodiment, the determination comprises first the border change condition determiner 623A of the outcome evaluator 623 determining whether the selected symbols of the initial outcomes for each of the game instances include one or more winning symbol combinations as specified in pay table 643.

In an embodiment, evaluation of the selected symbols is based at least on selections made as part of the player's wager, for example a number of reels selected by the player which define a number of ways to win. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win.

In another embodiment, a player may select a number of lines to play. In many games, the player's wager is not strictly limited to the reels or lines they have selected, for example, "scatter" pays are awarded independently of a players selection of pay lines.

In an embodiment, the border change condition determiner 623A determines whether there is no winning outcome independently of the player's wager, for example on the basis that all reels are selected irrespective of how many reels the player has selected.

In other embodiments, the border change triggering event may be, a symbol combination in the game, occurrence of a specific symbol in the game, be caused by another connected system, be based on turnover, be based on a random evaluation, etc.

Returning now to FIG. 6, upon the border change condition determiner 623A determining that one of the game instances contains a losing outcome, a random determination is conducted by border change condition evaluator 623A using random number generator 621 to determine whether a border change should be carried out. For example, by determining whether a number returned by random number generator 621 falls within a range of numbers allocated to a border change. Accordingly, it will be appreciated that in this embodiment, there are two parts to the border change condition, firstly that there is a losing outcome and secondly whether the randomly generated number matches a defined range.

When a border change condition is satisfied, the symbol display position allocator 622B calculates a revised allocation of symbols based on symbol allocation rules 643.

Assuming, that the second gaming instance is the losing game instance, symbols are reallocated from the second gaming instance to the first game instance. In an embodiment, symbol allocation rules 643 specify that the left most of the reels has a defined number of symbol display positions exchanged between the first and second game instances, in one example two symbol display positions. The symbol allocation rules 643 also specify that a random number of symbol display positions are selected for each of the other reels from a set of possible outcomes. In one example, the symbol display position allocator 622B uses values obtained from random number generator to select either zero, one, or two symbol display positions to be reallocated from the second game instance to the first game instance.

Persons skilled in the art will appreciate that other embodiments are possible. For example, in one embodiment, the border change condition may be that a random result indicates that a border change should occur independently of whether one of the game instances has a losing outcome. In one example, the symbol display position allocator 622B determines for each reel, whether to add one symbol to the first game instance, do nothing or add one symbol to the second game instance such that in each game instance could either gain or lose a symbol display position for each reel. It will be appreciated that in such an embodiment, the nett result of the symbol reallocation conducted by the symbol display position allocator 622B could be that each game instance has the same number of symbol display positions following the reallocation but the specific symbol display positions allocated to the game instances have changed.

Once the allocation of symbol display positions has occurred, symbols derived from the previously selected stopping positions of the reels will be displayed at the added stopping positions. That is, it will be appreciated that if a symbol display position is added to one of the game instances, the next symbol on the reel can be displayed at this position. In other embodiments, the symbol selector 622A may separately select the symbols for display at the revised symbol display positions or may select the symbols for display after the allocation of symbols between the two gaming instances in order to cause the border to change. For example in one embodiment, a random determination may be conducted before the reels are spun to determine whether the border is to be changed and the symbol display position allocation is to be changed by the symbol display position allocator 622B such that it is changed prior to the symbols being selected.

An example of a changed border is shown in FIG. 8A, which shows revised presentations of the first and second game instances 820B, 830B. It will be appreciated that symbol display positions 851 and 852 have been allocated to the first gaming instance 820B leading to a change in the border 840B between the two game instances 820B, 830B.

The outcome evaluator evaluates the game outcome based on the revised game instances 820B. (Bearing in mind that in this example, game 830B will not include a winning outcome.) Any awards are advised to and added to the win meter stored in meter data 644.

It will be apparent to the skilled person that by extending the symbol positions available in the first game instance in FIG. 8B, there is an increased chance of winning outcomes occurring in the first game instance.

Figure 7:
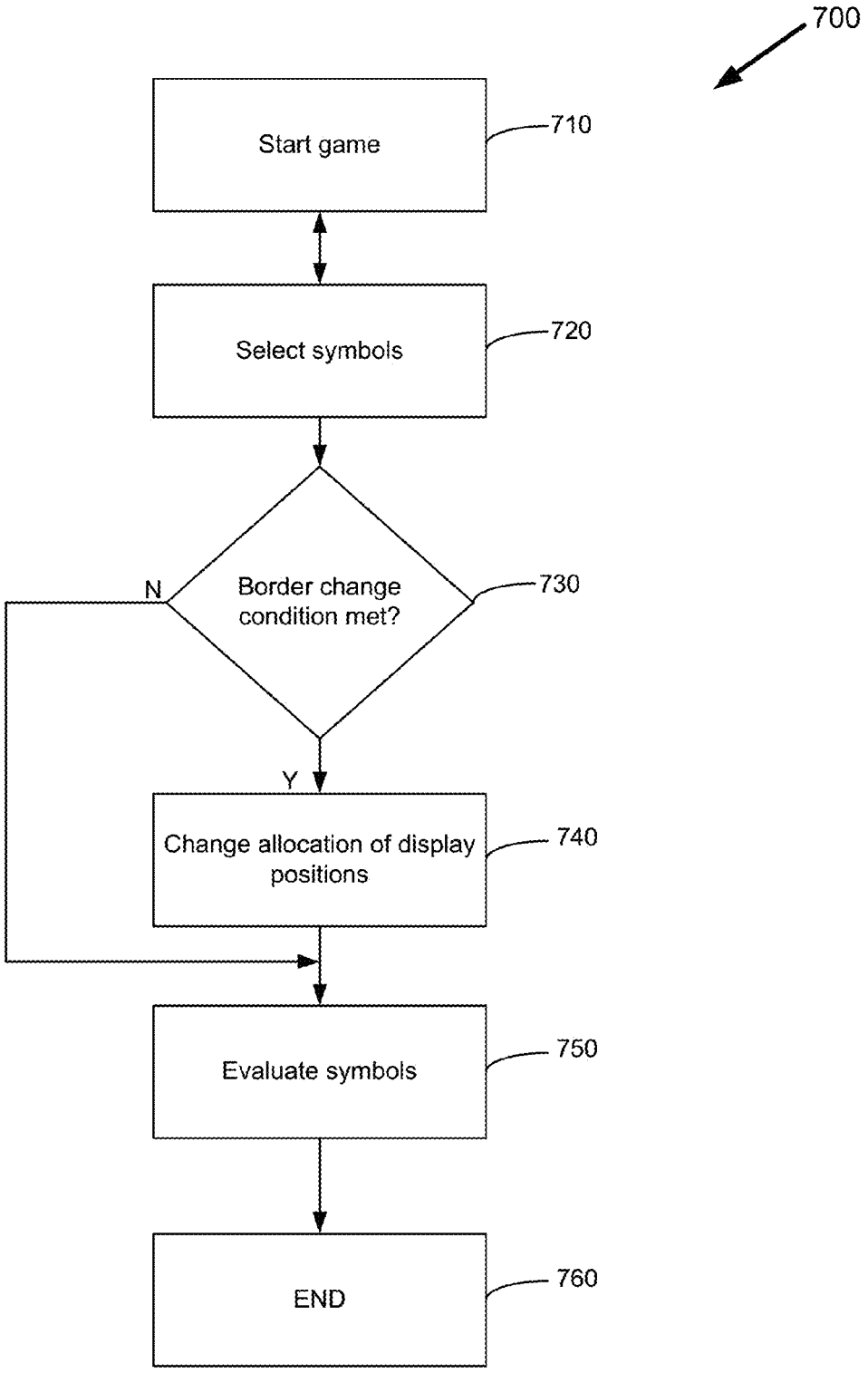
FIG. 7 is a flow chart of an embodiment.

Referring to FIG. 7, a method of an embodiment of the invention is summarised. The method 700 involves starting the game 710, selecting symbols 720 and determining whether a border change condition is met 730. If it is not met the method proceeds to evaluating the symbols 750 to determine whether to make any award and the game ends 760. In the case that the border change condition is met, the allocation of display positions is changed 740 and the symbols are evaluated 750.

Persons skilled in the art will appreciate that there are a number of alternative embodiments. Firstly, in the above described embodiment, the player plays both gaming instances. In other embodiments, gaming instances could be allocated to separate players in a competition between players. One of the players could be a "computer" player. Games between two players lend themselves to, for example, a tournament mode.

Further, while the above embodiment shows separate symbol sets being used to populate the two different areas, the symbols from the same symbol set could be used to populate the areas allocated to the two game instances.

Further, it will be appreciated that while the above embodiment has been described in relation to a neutral starting point between the two game instances, the game could start with one game instance having allocated to it than the other game instance. Similarly, the game could be conducted as a series of free games where there are multiple changes of border positions during the series of free games. For example, the allocation of symbols between the first and second game instances may be determined randomly for each spin of the reels.

In yet another embodiment, the border could run vertically. In one embodiment there could be five reels on one side of the border initially and five reels on the other side of the border. Changes to the border could result in a single symbol display position or the entirety of a reel being reallocated between the two gaming instances.

In some embodiments, an eligibility criteria may be applied for the player to be entitled to both gaming instances and/or the border change feature, for example that the player has made a certain sized wager, made an ante bet, selected all reels, played sufficient games, or the player is a member of a loyalty program.

EXAMPLE

Figure 9:
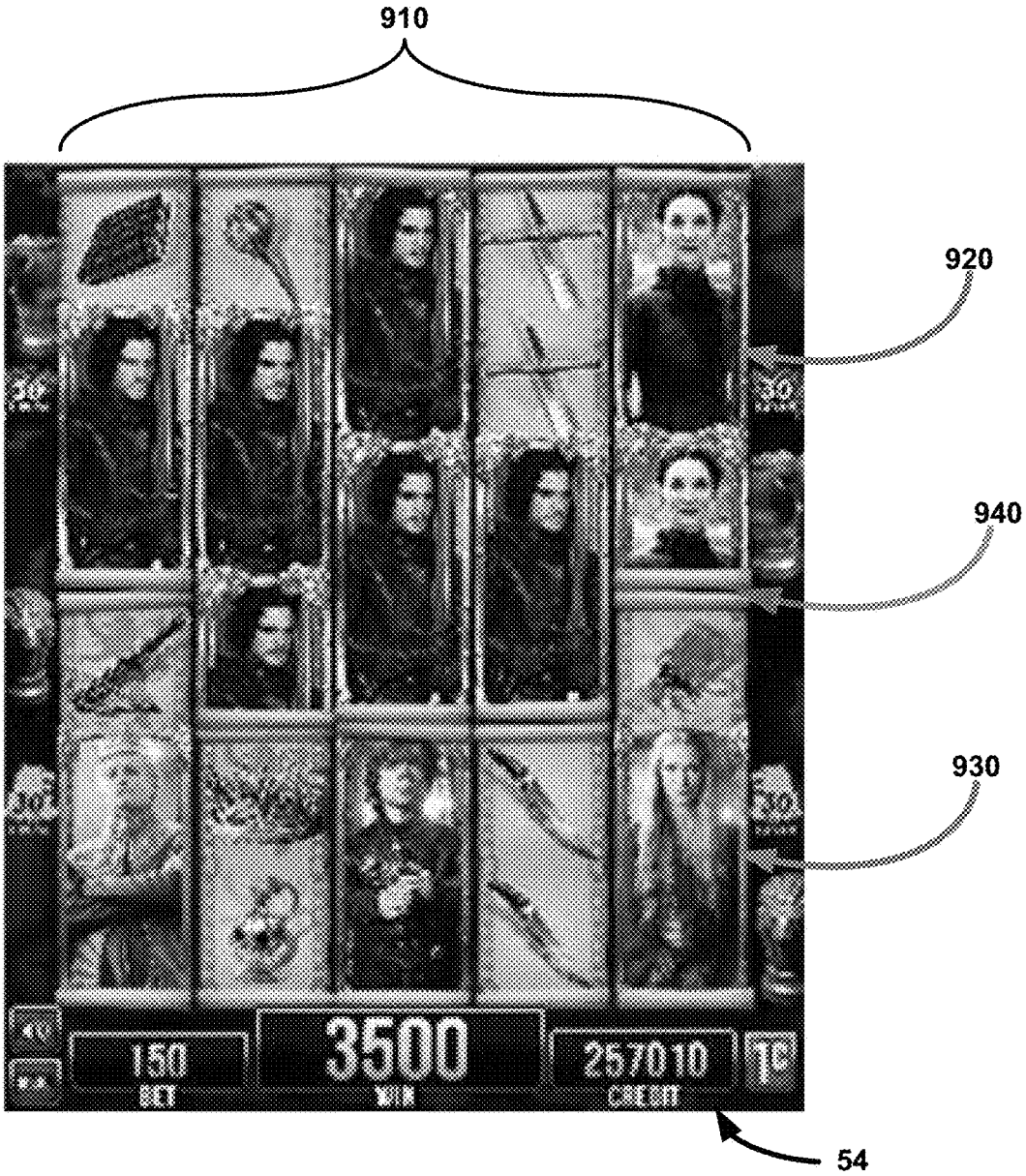
FIG. 9 is a screen shot of an example of a game in accordance with an embodiment of the invention.

Referring to FIG. 9, there is an example of a display 54 of a gaming system after a reallocation of symbol display positions. The symbol display area 910 displays a first game instance 920 divided by border 940 from second gaming instance 930. It will be apparent from FIG. 3 that one symbol display positions of each of the middle three reels have been reallocated from the second gaming instance 930 to the first gaming instance 920.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of gaming in a gaming system comprising: a display, a game controller having at least one processor and memory device configured to operate the gaming system, an acceptor and cashout device, wherein a credit input mechanism is configured to receive a physical item via the acceptor representing a monetary value to enable a player to input credits for establishing a credit balance, hardware meters configured to monitor the credit input having been provided by the credit input mechanism for establishing the credit balance, the credit balance being increasable and decreasable, and an output mechanism configured to cause a payout via the cashout device associated with the credit balance, the method comprising:

displaying, on the display, an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance;

selecting, by the game controller, symbols for each of the symbol display positions of the first and second game instances after the evaluation area having the first and second gaming instances divided by the border is displayed;

upon a border change condition being met, adjusting, using the game controller, the allocation of symbol display positions between the first game instance and the second game instance so that the border between the first and second game instances changes while maintaining the symbols selected for non-reallocated symbol display positions of both the first and second gaming instances; and determining, using the game controller, whether to make an award in respect of at least one of the first and second game instances based on the symbols displayed at the symbol display positions after the border changes.

2. The method of claim 1, wherein adjustment in the allocation of symbol display positions results in one of the first and second gaming instances being allocated at least one more symbol display positions previously allocated to the other of the first and second gaming instances.

3. The method of claim 1, wherein adjustment in the allocation of symbol display positions results in one of the first and second gaming instances having more symbol display positions than previously and the other of the first and second gaming instances having fewer symbol display positions than previously.

4. The method of claim 1, wherein the selecting the symbols for the first and second gaming instances is independent of one another.

5. The method of claim 4, wherein the selecting the symbols is from a first symbol set for the first gaming instance and from a second, different symbol set for the second gaming instance.

6. The method of claim 1, wherein the border divides the columns of symbol display positions between each gaming instance.

7. The method of claim 6, wherein adjusting the allocation of symbol display positions comprises adjusting the symbol display positions of one or more columns.

8. The method of claim 7, wherein the adjustment to the allocation of symbol display positions in at least one column is randomly determined from a set of possible adjustments.

9. The method of claim 8, wherein the set of possible adjustments is 0, 1 or 2 symbol display positions.

10. The method of claim 7, wherein the adjustment to the allocation of symbol display positions in at least one column is defined.

11. The method of claim 1, comprising determining after the selection but prior to display of the symbols of the gaming instances whether the selected symbols for symbol display positions of one of the gaming instances correspond to a losing outcome, and wherein the border change condition includes that one of the gaming instances has a losing game outcome.

12. An electronic game controller comprising:

at least one processor and memory device configured to operate a gaming machine, wherein the gaming machine comprises an acceptor and cashout device, wherein a credit input mechanism operable by a player is configured to receive a physical item via the acceptor representing a monetary value to enable a player to input credits for establishing a credit balance, hardware meters configured to monitor the credit input having been provided by the credit input mechanism for establishing the credit balance, the credit balance being increasable and decreasable, and an output mechanism configured to cause a payout via the cashout device associated with the credit balance;

a display controller configured to control a display of a gaming system to display an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance;

a symbol selector configured to select symbols for each of the symbol display positions of the first and second game instances after the evaluation area having the first and second gaming instances divided by the border is displayed;

a symbol display position allocator configured to, upon a border change condition being met, adjust the allocation of symbol display positions between the first game instance and the second game instance so that the border between the first and second game instances changes while maintaining the symbols selected for non-reallocated symbol display positions of both the first and second gaming instances; and an outcome evaluator configured to determine whether to make an award in respect of at least one of the first and second game instances based on the symbols displayed at the symbol display positions after the border changes.

13. The electronic game controller of claim 12, wherein adjustment in the allocation of symbol display positions results in one of the first and second gaming instances being allocated at least one more symbol display positions previously allocated to the other of the first and second gaming instances.

14. The electronic game controller of claim 12, wherein adjustment in the allocation of symbol display positions results in one of the first and second gaming instances having more symbol display positions than previously and the other of the first and second gaming instances having fewer symbol display positions than previously.

15. The electronic game controller of claim 12, wherein the symbols for the first and second gaming instances are selected independently of one another.

16. The electronic game controller of claim 15, wherein the symbols for the first gaming instance are selected from a first symbol set and the symbols for the second gaming instance are selected from a second, different symbol set.

17. The electronic game controller of claim 12, wherein the border divides the columns of symbol display positions between each gaming instance.

18. The electronic game controller of claim 17, wherein adjusting the allocation of symbol display positions comprises adjusting the symbol display positions of one or more columns.

19. The electronic game controller of claim 18, wherein the adjustment to the allocation of symbol display positions in at least one column is randomly determined from a set of possible adjustments.

20. The electronic game controller of claim 19, wherein the set of possible adjustments is 0, 1 or 2 symbol display positions.

21. The electronic game controller of claim 18, wherein the adjustment to the allocation of symbol display positions in at least one column is defined.

22. The electronic game controller of claim 12, comprising determining after the selection but prior to display of the symbols of the gaming instances whether the selected symbols for symbol display positions of one of the gaming instances correspond to a losing outcome, and wherein the border change condition includes that one of the gaming instances has a losing game outcome.

23. A gaming system comprising:

an acceptor and cashout device, wherein a credit input mechanism is configured to receive a physical item via the acceptor representing a monetary value to enable a player to input credits for establishing a credit balance;

hardware meters configured to monitor the credit input having been provided by the credit input mechanism for establishing the credit balance, the credit balance being increasable and decreasable;

an output mechanism configured to cause a payout via the cashout device associated with the credit balance;

a display; and a game controller having at least one processor and memory device configured to operate the gaming system, the game controller configured to:

control the display to displaying an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance;

select symbols for each of the symbol display positions of the first and second game instances after the evaluation area having the first and second gaming instances divided by the border is displayed;

upon a border change condition being met, adjust the allocation of symbol display positions between the first game instance and the second game instance so that the border between the first and second game instances changes while maintaining the symbols selected for non-reallocated symbol display positions of both the first and second gaming instances; and determine whether to make an award in respect of at least one of the first and second game instances based on the symbols displayed at the symbol display positions after the border changes.

24. A gaming system comprising:

means for receiving a physical item representing a monetary value to enable a player to input credits for establishing a credit balance;

means for monitoring the credit input for establishing the credit balance, the credit balance being increasable and decreasable;

means for causing a payout associated with the credit balance;

means for displaying an evaluation area comprising a plurality of columns of symbol display positions, wherein the symbol display positions are divided between first and second gaming instances by a border such that symbol display positions on one side of the border are allocated to the first game instance and symbol display positions on the other side of the border are allocated to the second game instance;

means for selecting symbols for each of the symbol display positions of the first and second game instances after the evaluation area having the first and second gaming instances divided by the border is displayed;

means for upon a border change condition being met, adjusting the allocation of symbol display positions between the first game instance and the second game instance so that the border between the first and second game instances changes while maintaining the symbols selected for non-reallocated symbol display positions of both the first and second gaming instances; and means for determining whether to make an award in respect of at least one of the first and second game instances based on the symbols displayed at the symbol display positions after the border changes.

25. The method of claim 1, further comprising executing computer program code.

26. The method of claim 25, further comprising storing the computer program code in a tangible computer readable medium.

* * * * *